US009696090B2

(12) United States Patent
Nakano et al.

(10) Patent No.: US 9,696,090 B2
(45) Date of Patent: Jul. 4, 2017

(54) THERMAL PROCESSING FURNACE FOR WORKPIECES

(71) Applicant: Chugai Ro Co., Ltd., Osaka-shi (JP)

(72) Inventors: Masaaki Nakano, Osaka (JP); Sousaku Takeuchi, Osaka (JP)

(73) Assignee: CHUGAI RO CO., LTD. (JP)

( * ) Notice: Subject to any disclaimer, the term of this patent is extended or adjusted under 35 U.S.C. 154(b) by 283 days.

(21) Appl. No.: 14/415,024

(22) PCT Filed: Jun. 4, 2013

(86) PCT No.: PCT/JP2013/065433
§ 371 (c)(1),
(2) Date: Jan. 15, 2015

(87) PCT Pub. No.: WO2014/017176
PCT Pub. Date: Jan. 30, 2014

(65) Prior Publication Data

US 2015/0176901 A1 Jun. 25, 2015

(30) Foreign Application Priority Data

Jul. 26, 2012 (JP) ..... 2012-166355

(51) Int. Cl.

| | |
|---|---|
| ***F27B 9/36*** | (2006.01) |
| ***C21D 9/00*** | (2006.01) |
| ***F27B 9/30*** | (2006.01) |
| ***F27B 9/38*** | (2006.01) |
| ***F27B 9/40*** | (2006.01) |

(Continued)

(52) U.S. Cl.
CPC ..... *F27B 9/36* (2013.01); *C21D 9/0056* (2013.01); *F27B 9/10* (2013.01); *F27B 9/2407* (2013.01); *F27B 9/3005* (2013.01); *F27B 9/38* (2013.01); *F27B 9/40* (2013.01); *F27D 19/00* (2013.01); *F27D 99/0001* (2013.01); *C21D 1/34* (2013.01); *C21D 1/767* (2013.01); *C21D 9/0006* (2013.01);

(Continued)

(58) Field of Classification Search
CPC ..... C21D 9/0006; F27B 9/36
See application file for complete search history.

(56) References Cited

U.S. PATENT DOCUMENTS 3,841,614 A * 10/1974 Okuno ..... B21B 45/004 432/133
2015/0176901 A1* 6/2015 Nakano ..... F27B 9/2407 266/92

FOREIGN PATENT DOCUMENTS

JP 52-106114 A 9/1977
JP 53-072711 A 6/1978

(Continued)

*Primary Examiner* — Scott Kastler
(74) *Attorney, Agent, or Firm* — DLA Piper LLP (US)

(57) ABSTRACT

A thermal processing furnace for workpieces has a blowing hood in which a nozzle is installed, the nozzle blowing a gas flow to thermally process a workpiece, including a driving mechanism that adjusts a distance between the nozzle and a portion of the workpiece facing the nozzle so that the gas flow blown from the nozzle impinges on workpieces of various dimensions at a desired flow velocity, wherein a plurality of nozzles are arranged as the nozzle along a conveying direction of the workpiece in a zone where the thermal processing is performed, and the driving mechanism adjusts a distance between each of the nozzles and a portion of the workpiece facing the nozzle individually in each of the plurality of nozzles.

8 Claims, 5 Drawing Sheets

(51) Int. Cl.

| | |
|---|---|
| ***F27D 19/00*** | (2006.01) |
| ***F27D 99/00*** | (2010.01) |
| ***F27B 9/10*** | (2006.01) |
| ***F27B 9/24*** | (2006.01) |
| *C21D 1/767* | (2006.01) |
| *C21D 11/00* | (2006.01) |
| *C21D 1/34* | (2006.01) |

(52) U.S. Cl.
CPC ..... *C21D 11/00* (2013.01); *F27B 2009/382* (2013.01); *F27D 2099/0065* (2013.01)

(56) References Cited

FOREIGN PATENT DOCUMENTS

| | | | |
|---|---|---|---|
| JP | 2004-067509 | A | 3/2004 |
| JP | 2006-284156 | A | 10/2006 |
| JP | 2009-057621 | A | 3/2009 |

* cited by examiner

THERMAL PROCESSING FURNACE FOR WORKPIECES

TECHNICAL FIELD

This disclosure relates to a thermal processing furnace for workpieces having a blowing hood in which a nozzle is installed, the nozzle blowing a gas flow to perform thermal processing such as heating, soaking, and cooling on the workpieces, and relates to a thermal processing furnace for workpieces capable of efficiently performing thermal processing by causing a gas flow having a high flow velocity to impinge on the workpieces regardless of the dimensions of the workpieces, thereby contributing to space saving and energy conservation.

BACKGROUND

Some thermal processing furnaces for workpieces such as steel materials, having thermal conductivity by heating, soaking, or cooling the workpieces include a blowing hood, and are configured to blow hot air or cold air as a gas flow from a nozzle provided in the blowing hood.

For example, a "continuous heating furnace" in Japanese Patent Laid-Open No. 2009-57621 is a heating furnace which heats and soaks a steel material by continuously conveying the steel material, the continuous heating furnace including a combustion burner, a fan that circulates a flue gas within the furnace, a partition plate that covers a steel material conveyance path and guides the flue gas from a furnace bottom to its top, and a slit plate that regulates the flow of the flue gas above the steel material conveyance path and below the partition plate, wherein a slit width of the slit plate changes in a steel material conveying direction. Thus, the continuous heating furnace has excellent temperature rising and furnace temperature distribution characteristics. The slit corresponds to the nozzle, and the steel material is conveyed by a walking beam.

In the past, a steel material conveying surface of the walking beam and the slit plate where the slit blowing a gas flow is formed have a constant distance relationship. Therefore, roughly speaking, a distance between the steel material and the slit varies depending on the magnitude of the dimensions of the steel material on the steel material conveying surface. To be more specific, there is such a distance relationship that a steel material having a large height dimension is located close to the slit, and a steel material having a small height dimension is located far from the slit.

The gas flow of the flue gas blown from the slit has a high flow velocity immediately after being blown out, while the gas flow is diffused and the flow velocity is decreased with distance from the slit. When the steel material is thermally processed by causing the gas flow to impinge on the steel material, heat is more efficiently transferred from the gas flow to the steel material as the flow velocity is higher, that is, as the distance between the steel material and the slit is smaller.

Based on the above description, a steel material having a smaller height dimension is located farther from the slit so that the flow velocity of the gas flow impinging on the steel material is decreased, and it is difficult to ensure sufficient heat transfer. Therefore, it takes a long time until the steel material is heated to a desired temperature.

When a thermal processing furnace that handles steel materials of various dimensions is designed, it is necessary to determine a height dimension from a steel material conveying surface to a slit plate located above the surface based on the dimensions of a tallest steel material. Meanwhile, it is also necessary to determine a heating time required to heat the steel material to a desired temperature based on the dimensions of a shortest steel material with poor heat transfer. Thus, to ensure the heating time, a facility having large heating capacity is required, and a large facility space is required since the furnace is extended in a conveying direction.

It could therefore be helpful to provide a thermal processing furnace for workpieces having a blowing hood in which a nozzle is installed, the nozzle blowing a gas flow to perform thermal processing such as heating, soaking, and cooling on the workpieces, and to provide a thermal processing furnace for workpieces capable of efficiently performing thermal processing by causing a gas flow having a high flow velocity to impinge on the workpieces regardless of the dimensions of the workpieces, thereby contributing to space saving and energy conservation.

SUMMARY

We thus provide:

Our thermal processing furnace for workpieces is a thermal processing furnace for workpieces having a blowing hood in which a nozzle is installed, the nozzle blowing a gas flow to thermally process a work piece, the thermal processing furnace including a driving mechanism that adjusts a distance between the nozzle and a portion of the work piece facing the nozzle so that the gas flow blown from the nozzle impinges on workpieces of various dimensions at a desired flow velocity.

The driving mechanism adjusts the distance between the nozzle and the portion of the work piece facing the nozzle so that the gas flow blown from the nozzle impinges on the workpieces of various dimensions at a constant flow velocity.

The driving mechanism drives the blowing hood or the nozzle to adjust the distance between the nozzle and the portion of the work piece.

A plurality of nozzles are arranged as the nozzle along a conveying direction of the workpiece in a zone where the thermal processing is performed, and the driving mechanism adjusts a distance between each of the nozzles and a portion of the workpiece facing the nozzle individually in each of the plurality of nozzles.

The workpiece is conveyed by a conveyor while moving up and down, and the driving mechanism adjusts the distance between the nozzle and the portion of the workpiece facing the nozzle in synchronization with a timing of the up-and-down motions of the workpiece so that an up-and-down speed and an up-and-down stroke of the adjustment are equivalent to an up-and-down speed and an up-and-down stroke of the workpiece, respectively.

The furnace further includes a controller to which information on a dimension of the workpiece is input, the controller connected to the driving mechanism, and outputting information on the dimension of the workpiece to control the driving mechanism.

The furnace further includes a sensor that automatically detects the dimension of the workpiece in advance, and inputs the dimension to the controller.

Our thermal processing furnace for workpieces is thus directed to a thermal processing furnace for workpieces having a blowing hood in which a nozzle is installed, the nozzle blowing a gas flow to perform thermal processing such as heating, soaking, and cooling on the workpieces, the furnace capable of efficiently performing thermal processing by causing a gas flow having a high flow velocity to impinge on the workpieces regardless of the dimensions of the workpieces, thereby contributing to space saving and energy conservation.

REFERENCE SIGNS LIST

Figure 1:
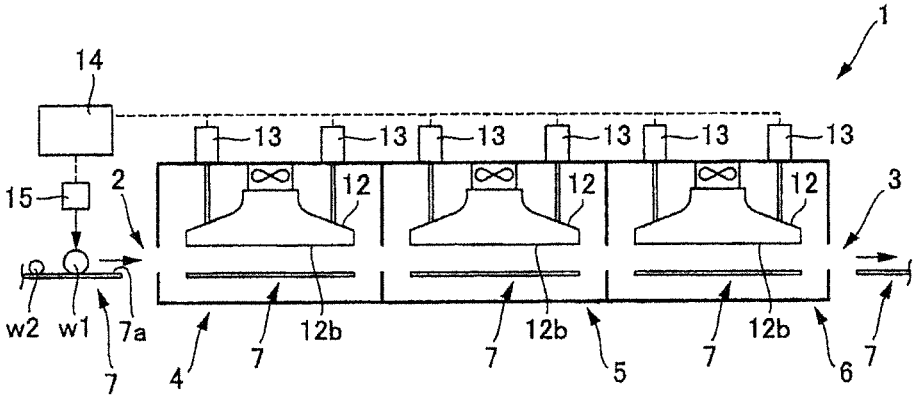
FIG. 1 is a schematic sectional side view illustrating one preferable example of a thermal processing furnace for workpieces.

1 Thermal processing furnace for workpieces
2 Charging port
3 Ejection port
4 Heating zone
5 Soaking zone
6 Cooling zone
7 Conveyor
7*a* Conveying surface
8 Inlet opening
9 Outlet opening
10 Furnace body
11 Circulating fan device
11*a* Hollow duct
11*b* Fan
12 Blowing hood
12*a* Sliding tube section
12*b* Nozzle
13 Driving mechanism
13*a* Driving section
13*b* Rod
14 Controller
15 Sensor
20 Support plate with blow hole
21 Sliding section
F Gas flow
D, d1, d2, H Distance
L Length dimension of blowing hood (or nozzle) in conveying direction
w (w1, w2) Work piece having thermal conductivity
X Portion of workpiece facing nozzle
Y Diffusion of gas flow

DETAILED DESCRIPTION

Figure 2:
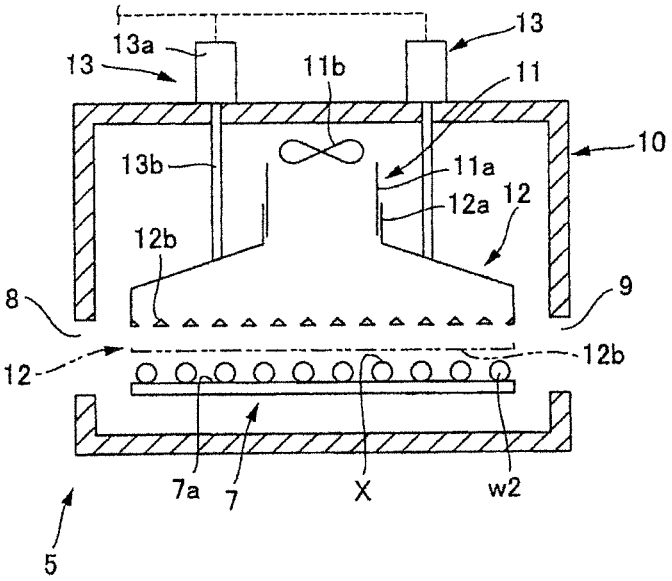
FIG. 2 is an enlarged schematic sectional side view of a soaking zone of the thermal processing furnace for workpieces shown in FIG. 1.
Figure 4:
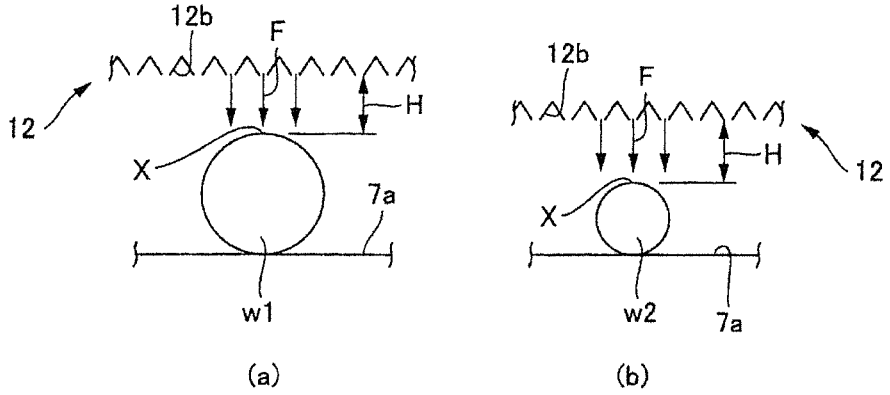
FIGS. 4(*a*) and (*b*) are explanatory views explaining a thermal processing state using the thermal processing furnace for workpieces shown in FIG. 1.

In the following, one preferable example of a thermal processing furnace for workpieces is described in detail by reference to the accompanying drawings. A thermal processing furnace 1 is basically a thermal processing furnace 1 having a blowing hood 12 in which a nozzle 12*b* is installed, the nozzle 12*b* blowing a gas flow F to thermally process workpieces w1 and w2, the furnace 1 including a driving mechanism 13 that adjusts a distance H between the nozzle 12*b* and a portion X of the work piece facing the nozzle 12*b* so that the gas flow F blown from the nozzle 12*b* impinges on the workpieces w1 and w2 of various dimensions at a desired flow velocity as shown in FIGS. 1, 2, and 4(*a*) and (*b*). The thermal processing includes surface processing such as quenching in addition to heating and cooling processes.

The driving mechanism 13 adjusts the distance H between the nozzle 12*b* and the portion X of the work piece facing the nozzle 12*b* so that the gas flow F blown from the nozzle 12*b* impinges on the workpieces w (w1 and w2) of various dimensions at a constant flow velocity. The driving mechanism 13 drives the blowing hood 12 to adjust the distance H between the nozzle 12*b* and the portion X of the workpiece.

A controller 14 to which information on the dimensions of the workpieces w is input is provided. The controller 14 connects to the driving mechanism 13, and outputs information on the dimensions of the workpieces w to control the driving mechanism 13. A sensor 15 that automatically detects the dimensions of the workpieces w in advance and inputs the dimensions to the controller 14 is provided.

FIG. 1 shows a schematic sectional side view of the thermal processing furnace 1. The thermal processing furnace 1 includes a heating zone 4, a soaking zone 5, and a cooling zone 6 from a charging port 2 to an ejection port 3 for the workpieces w (w1; a workpiece having a large height dimension, w2; a workpiece having a small height dimension).

The thermal processing furnace 1 applies thermal processing such as heating, soaking and cooling to the workpieces w sequentially and continuously passing through the zones 4 to 6. The furnace 1 performs the thermal processing on the workpieces w such as steel materials having thermal conductivity. The furnace 1 is provided with a conveyor 7 including a conveying surface 7*a* to convey the workpieces w from the side of the charging port 2 to the side of the ejection port 3 through the respective zones 4 to 6. Any means such as walking beam-type, pressure-type, belt-type and roller-type means may be employed as the conveyor 7.

The workpieces w conveyed by the conveyor 7 are charged into the heating zone 4 from the charging port 2 and heated therein, subsequently soaked in the soaking zone 5, subsequently cooled in the cooling zone 6, and thereafter ejected outside of the furnace 1 from the ejection port 3. The configuration of the furnace 1 in the drawing is merely one example, and the furnace 1 may include at least one of the zones 4 to 6 such as the soaking zone, or may include an additional zone.

FIG. 2 shows an enlarged schematic sectional side view of the soaking zone 5 out of the heating zone 4, the soaking zone 5, and the cooling zone 6. The heating zone 4 and the cooling zone 6 have substantially the same configuration as the soaking zone 5.

The soaking zone 5 includes a furnace body 10 having an inlet opening 8 and an outlet opening 9 that communicate with the heating zone 4 and the cooling zone 6 on the both sides. The above conveyor 7 arranged on a bottom portion of the furnace body 10, a circulating fan device 11 arranged on a top portion of the furnace body 10, the blowing hood 12 provided above the conveying surface 7*a* of the conveyor 7, and a heating device (not shown) that heats a furnace atmosphere to maintain the furnace atmosphere in a given high-temperature state are provided in an internal space of the furnace body 10.

The circulating fan device 11 is composed of a hollow duct 11*a* whose upper end and lower end are open, and a fan 11*b* that is provided at the upper end of the hollow duct 11*a*, and circulates the furnace atmosphere heated by the heating device within the furnace body 10. Particularly, the fan 11*b* generates a downward gas flow from the top portion side toward the conveying surface 7*a* by the blowing hood 12.

The blowing hood 12 is formed to be downwardly enlarged toward the end. A sliding tube section 12*a* is provided at a narrowed upper end of the blowing hood 12. The sliding tube section 12*a* connects to the hollow duct 11*a* to be slidable in a vertical direction without letting the gas flow from the fan 11*b* escape to the outside. The nozzle 12*b* having a planar shape is provided facing the conveying surface 7*a* inside an enlarged lower end of the blowing hood 12.

The planar nozzle 12*b* is composed of a mesh-like plate member where a plurality of holes is formed, or a mountain-shaped plate member provided with slits. The plurality of holes or slits face the conveying surface 7*a*. The downward gas flow generated by the fan 11*b* is blown from the holes of the nozzle 12*b* toward the conveying surface 7*a* through an internal space of the blowing hood 12. The workpieces w are thermally processed by the blown gas flow.

The blowing hood 12 is provided with the driving mechanism 13 that drives the blowing hood 12. The driving mechanism 13 is composed of a driving section 13*a* installed on the top portion of the furnace body 10, and a rod 13*b* that penetrates the furnace body 10, with one end coupled to the driving section 13*a* and the other end coupled to the blowing hood 12 in the example shown in the drawings. When the driving section 13*a* is driven, the rod 13*b* moves up and down so that the blowing hood 12 is driven up and down in the vertical direction with respect to the conveying surface 7*a* with the sliding tube section 12*a* sliding with respect to the hollow duct 11*a*.

By moving the blowing hood 12 close to and away from the conveying surface 7*a* of the conveyor 7 that conveys the workpieces w, a distance between the workpieces w on the conveying surface 7*a* and the nozzle 12*b* of the blowing hood 12 is adjusted. Any mechanism such as cylinder-type and rack-and-pinion-type mechanisms may be employed as the driving mechanism 13 as long as the mechanism can drive the blowing hood 12 to move close to and away from the conveying surface 7*a*.

The downward gas flow blown from the nozzle 12*b* impinges on the workpieces w. When the nozzle 12*b* and the workpieces w are in a vertical relationship as in this example, the gas flow tends to impinge on the portion X of the workpiece facing the nozzle 12*b*, i.e., a top portion in a height direction of the workpiece w on the conveying surface 7*a*.

When the workpieces w having different height dimensions are conveyed and thermally processed, the driving mechanism 13 drives the blowing hood 12 up and down with respect to the workpieces w so that a distance between the workpiece portion (the workpiece top portion) X facing the nozzle 12*b* of each of these workpieces w and the nozzle 12*b* becomes constant. Since the distance is adjusted to be constant, the gas flow blown from the nozzle 12*b* impinges on the workpieces w having different height dimensions at a constant flow velocity.

Figure 5:
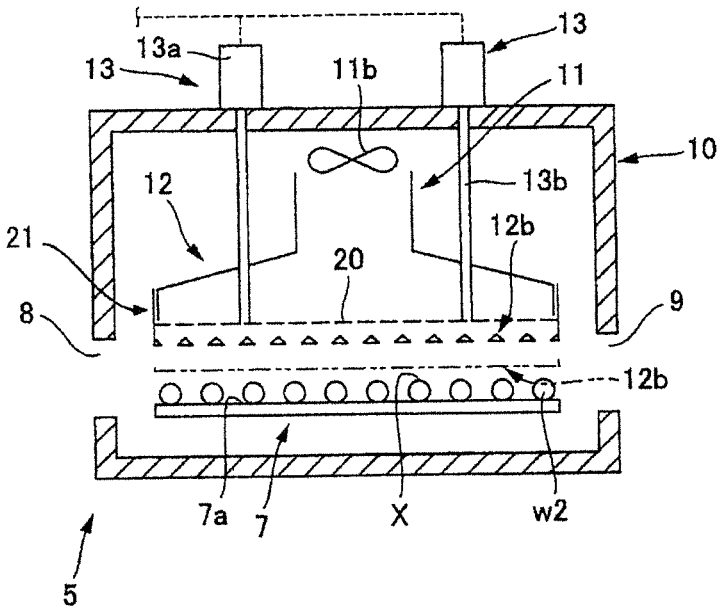
FIG. 5 is an enlarged schematic sectional side view, corresponding to FIG. 2, illustrating a modification of the thermal processing furnace.

Naturally, the flow velocity of the gas flow impinging on the workpieces w can be controlled by adjusting the distance between the nozzle 12*b* and the workpiece portion X, and the gas flow can be caused to impinge on the workpieces w at a desired flow velocity. Also, the driving mechanism 13 is not limited to driving the blowing hood 12 up and down. As in a modification shown in FIG. 5, the blowing hood 12 may be fixed to the furnace body 10, the rod 13*b* of the driving mechanism 13 may penetrate through the blowing hood 12 and coupled to a support plate 20 with a blow hole provided on the nozzle 12*b*, and the nozzle 12*b* may be made slidable with respect to the blowing hood 12 by a sliding section 21 so that the nozzle 12*b* itself that is made vertically movable with respect to the blowing hood 12 may be driven up and down by moving the rod 13*b* up and down. In this case, the hollow duct 11*a* and the sliding tube section 12*a* are omitted, and the blowing hood 12 is configured in series and integrally with the circulating fan device 11.

Although the soaking zone 5 where the furnace atmosphere is circulated by the fan 11*b* is described in the above description, the heating zone 4 and the cooling zone 6 are configured similarly to the soaking zone 5 except that heating air or cooling air is supplied into the furnace from outside of the furnace, and the temperature-decreased or temperature-increased furnace atmosphere is discharged outside of the furnace.

An apparatus configuration that controls the drive of the driving mechanism 13 is shown in FIG. 1. The controller 14 that controls the driving section 13*a* of the driving mechanism 13 connects to the driving section 13*a*. The dimensions of the workpieces w, in this example, the height dimensions are input to the controller 14 by manual operation by an operator or the like.

The controller 14 outputs the input height dimensions of the workpieces w to the driving section 13*a*, and the driving section 13*a* vertically drives up and down the blowing hood 12 (or the nozzle 12*b*) according to the height dimensions of the workpieces w input from the controller 14 to adjust the distance between the nozzle 12*b* and the workpiece portion X facing the nozzle 12*b* to be constant even when the workpieces w have different height dimensions.

The furnace 1 may include the sensor 15 that automatically detects the height dimensions of the workpieces w in advance before the workpieces w are charged from the charging port 2. The sensor 15 connects to the controller 14, and automatically inputs the detected height dimensions of the workpieces w to the controller 14. When the sensor 15 is provided as described above, the blowing hood 12 (or the nozzle 12*b*) is also controlled by the automatic control.

Next, operation of the thermal processing furnace 1 is described. In the furnace 1, the thermal processing of the workpieces w is performed by continuously conveying the workpieces w (w1 and w2) brought together according to the height dimensions. When the height dimensions of the workpieces w are changed, all of the previous workpieces w having the same height are temporarily ejected, and the driving mechanism 13 then drives the blowing hood 12 (or the nozzle 12*b*) to change a height position in all of the zones 4 to 6 in response to the change in the height.

Also, the blowing hood 12 (or the nozzle 12*b*) is driven to be changed in the height position sequentially from the zones 4 to 6 where ejection of the workpieces w having the same height has been completed, and the new workpieces w having a different height dimension are charged therein. Accordingly, the length of time not contributing to production can be reduced.

To be more specific, when the height dimensions of the workpieces w are changed, the dimensions of the workpieces w are input to the controller 14 by manual operation.

Alternatively, the sensor 15 automatically detects the height dimensions of the workpieces w in advance, and the automatically-detected height dimensions are input to the controller 14.

The controller 14 to which the height dimensions have been input drives the driving mechanism 13 according to the height dimensions of the workpieces w to be subsequently processed, thereby moving up and down the blowing hood 12 (or the nozzle 12*b*) and adjusting the distance between the nozzle 12*b* and the workpiece portion X facing the nozzle 12*b*. That is, the driving mechanism 13 drives the blowing hood 12 (or the nozzle 12*b*) so that the distance between the nozzle 12*b* and the workpiece portion X facing the nozzle 12*b* always becomes constant even when the height dimensions of the workpieces w are changed.

After completion of preparation, the workpieces w having the same height dimension are sequentially charged from the charging port 2 of the furnace 1, thermally processed in the heating zone 4, the soaking zone 5, and the cooling zone 6, and ejected from the ejection port 3. After that, when the height dimensions of the workpieces w are changed, the driving mechanism 13 vertically drives up and down the blowing hood 12 (or the nozzle 12*b*) again to reset the height position.

Figure 3:
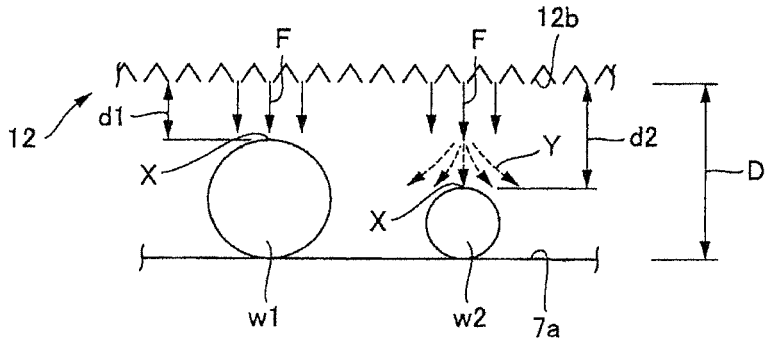
FIG. 3 is an explanatory view explaining a conventional thermal processing state.

In conventional cases shown in FIG. 3, a distance D between the blowing hood 12 and the conveying surface 7*a* is constant, and distances d1 and d2 between the nozzle 12*b* and the workpieces w1 and w2 vary depending on the height of the height dimensions of the workpieces w1 and w2 so that the flow velocity of the impinging gas flow F is changed. In that case, when the thermal processing is performed using the gas blown flow F from the nozzle 12*b*, it becomes necessary for the workpiece w2 having a small height dimension to be thermally processed for a long time since thermal conduction is deteriorated due to the flow velocity decreased by diffusion of the gas flow (indicated by dotted lines Y in the drawing).

On the other hand, in this example, the distance H between the nozzle 12*b* and the workpiece portion X facing the nozzle 12*b*, for example, the workpiece top portion is maintained constant by vertically driving up and down the blowing hood 12 (or the nozzle 12*b*) by the driving mechanism 13 in all of the heating zone 4, the soaking zone 5, and the cooling zone 6 so that the gas flow F having a constant flow velocity can be caused to impinge on the workpieces w (w1 and w2) as shown in FIGS. 4(*a*) and (*b*).

By causing the gas flow F to impinge on the workpieces w at a constant flow velocity, the workpieces w can be thermally processed with almost the same amounts of heat transferred thereto regardless of the height (the magnitude) of the dimensions. Even the workpiece w2 having a small height dimension can be thermally processed in substantially the same manner as the workpiece w1 having a large height dimension. Therefore, it becomes unnecessary to design the furnace 1 to have a large length for the workpiece w2 having a small height dimension. Thus, space saving is achieved for the facility space of the furnace 1, and energy conservation is also achieved.

Also, it becomes possible to cause the gas flow F having a high flow velocity to impinge on the workpieces w by bringing the blowing hood 12 (or the nozzle 12*b*) closer to the workpieces w so that the heat transfer is improved, the thermal processing can be efficiently performed, and a required thermal processing time can be shortened. Moreover, the space saving can be achieved by decreasing the length of the furnace 1. Energy conservation can be also achieved since a throughput per hour can be increased.

The controller 14 to which the dimensions of the workpieces w are input is provided, and the driving mechanism 13 connects to the controller 14, and drives the blowing hood 12 (or the nozzle 12*b*) according to the dimensions of the workpieces w output from the controller 14. Accordingly, the operability of the furnace 1 can be improved.

Since the sensor 15 that automatically detects the dimensions of the workpieces w in advance and inputs the dimensions to the controller 14 is provided, the furnace 1 can be automatically operated.

Also, existing furnaces can be easily modified and applied for the configuration of the thermal processing furnace 1. Substantially the same throughput can be ensured by stopping any of previously operated zones, and using a fewer zones.

Although a situation in which the blowing hood 12 (or the nozzle 12*b*) is vertically driven up and down to adjust the height between the nozzle 12*b* blowing the downward gas flow F and the workpiece portion X facing the nozzle 12*b* to be constant is described as an example above, the distance can be similarly adjusted by vertically driving up and down the blowing hood 12 (or the nozzle 12*b*) when the gas flow F is blown upwardly from the nozzle 12*b* toward a workpiece suspended from an upper portion.

Also, when the gas flow F is caused to impinge on the workpieces w from the nozzle 12*b* laterally in a horizontal direction, the blowing hood 12 (or the nozzle 12*b*) is driven in the right-left horizontal direction so that a horizontal distance between a portion of the workpiece facing the nozzle 12*b* (particularly, a right-left widthwise projecting portion or the like) and the nozzle 12*b* can be adjusted. Naturally, the same effects as those of the above example can be produced even in the modifications as described above.

Figure 6:
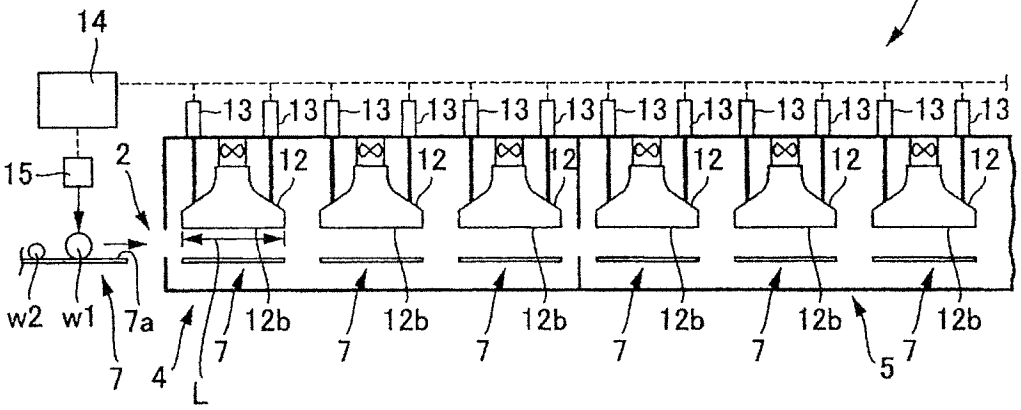
FIG. 6 is a schematic sectional side view, corresponding to FIG. 1, illustrating another modification of the thermal processing furnace.

FIG. 6 shows another modification of the thermal processing furnace 1. In the above example (see FIG. 1), the single blowing hood 12 (or the single nozzle 12*b*) is provided in each of the zones 4 to 6. The height position of the blowing hood 12 (or the nozzle 12*b*) is set according to the height dimensions of the preceding workpieces w to be subsequently conveyed thereto. When the following workpieces w having a different height dimension to be conveyed after the preceding workpieces w are thermally processed, the height position cannot be readjusted according to the following workpieces w before all of the preceding workpieces w pass below the blowing hood 12 (or the nozzle 12*b*).

That is, after the workpieces w are emptied with no workpiece present directly under the blowing hood 12 (or the nozzle 12*b*), the height of the blowing hood 12 (or the nozzle 12*b*) is readjusted.

At this point, if the blowing hood 12 (or the nozzle 12*b*) has a large length dimension in a conveying direction, a zone where no thermal processing is performed exists over a long distance in the facility of the furnace 1 so that a large loss is caused in terms of time and energy, and the furnace 1 has a larger size.

In this modification, a length dimension L of the blowing hood 12 (or the nozzle 12*b*) in the conveying direction is decreased. For example, a plurality of, for example, three blowing hoods 12 (or nozzles 12*b*) are arranged along the conveying direction of the workpieces w in each of the zones 4 to 6. In other words, the single blowing hood 12 (or the single nozzle 12*b*) provided in each of the zones 4 to 6 is divided into a plurality of portions. When the length of the zones 4 to 6 remains the same, the length dimension L of the blowing hood 12 (or the nozzle 12*b*) in the conveying direction is decreased.

The driving mechanism 13 adjusts the distance H between each of the blowing hoods 12 (or the nozzles 12*b*) and the workpiece portion X facing the nozzle 12*b* independently and individually in each of the plurality of blowing hoods 12 (or nozzles 12*b*).

When the height dimensions of the workpieces w are switched, the distance where the workpieces w are not present and are emptied can be reduced since the length dimension L of each of the blowing hoods 12 (or the nozzles 12*b*) in the conveying direction is small. Thus, the loss in terms of time and energy can be reduced, production efficiency can be improved, and the length of the furnace 1 can be also decreased.

Figure 7:
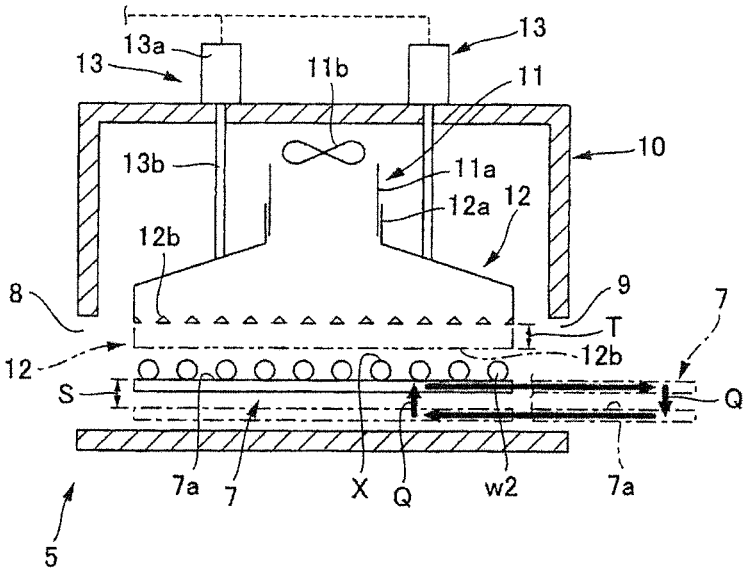
FIG. 7 is an enlarged schematic sectional side view, corresponding to FIG. 2, illustrating yet another modification of the thermal processing furnace.

FIG. 7 shows yet another modification of the thermal processing furnace 1. For example, when the conveyor 7 that conveys the workpieces w is of a type such as a walking beam type, that involves vertical movement of the conveying surface 7*a* (see an arrow Q out of arrows indicating a rectangular motion in FIG. 7), the distance H between the workpieces w and the blowing hood 12 (or the nozzle 12*b*) varies during conveyance, and the gas flow F blown from the nozzle 12*b* and impinging on the workpieces w becomes unstable. Especially when the distance H is widened, the air velocity drops to lower thermal efficiency. Therefore, the thermal processing cannot be expected to be properly performed at the stage of conveyance.

In this modification, when the workpieces w are conveyed by the conveyor 7 while moving up and down, the driving mechanism 13 adjusts the distance H between the nozzle 12*b* and the workpiece portion X facing the nozzle 12*b* to be always constant in synchronization with the timing of the up-and-down motions of the workpiece w so that an up-and-down speed and an up-and-down stroke T of the adjustment are equivalent to an up-and-down speed and an up-and-down stroke S of the workpiece w (the conveying surface 7*a*), respectively.

That is, in the walking beam type, the conveying surface 7*a* performs a rectangular motion or a circular motion within a vertical plane. The blowing hood 12 (or the nozzle 12*b*) is vertically moved by the driving mechanism 13 at the same speed and the same timing as those of a vertical component of the motion so that the distance H is always made constant.

A control value of the up-and-down motions of the conveyor 7 is input to the controller 14 in advance, and the driving mechanism 13 is driven according to the control value, thereby vertically driving the blowing hood 12 (or the nozzle 12*b*).

Accordingly, the workpieces w can be thermally processed by causing the air flow F from the nozzle 12*b* to precisely impinge on the workpieces w at all times not only at the stage in which the conveyor 7 stops conveying the workpieces w, but also at the stage of the conveyance. It is thus possible to shorten a required heating time, and decrease the length of the furnace 1.

Naturally, any of the blowing hood 12 and the nozzle 12*b* may be moved up and down in the modifications shown in FIGS. 6 and 7.

The invention claimed is:

1. A thermal processing furnace for workpieces having a blowing hood in which a nozzle is installed, the nozzle blowing a gas flow to thermally process a workpiece, comprising:

a driving mechanism that adjusts a distance between the nozzle and a portion of the workpiece facing the nozzle so that the gas flow blown from the nozzle impinges on workpieces of various dimensions at a desired flow velocity, a controller to which a dimension of the workpiece is input, the controller connected to the driving mechanism, and outputting the dimension of the workpiece to control the driving mechanism, and a sensor that automatically detects the dimension of the workpiece in advance, and inputs the dimension to the controller, wherein a plurality of nozzles are arranged as the nozzle along a conveying direction of the workpiece in a zone where the thermal processing is performed, and the driving mechanism adjusts a distance between each of the nozzles and a portion of the workpiece facing the nozzle individually in each of the plurality of nozzles.

2. The furnace according to claim 1, wherein the driving mechanism drives the blowing hood or the nozzle to adjust the distance between the nozzle and the portion of the workpiece.

3. A thermal processing furnace for workpieces having a blowing hood in which a nozzle is installed, the nozzle blowing a gas flow to thermally process a workpiece, comprising:

a driving mechanism that adjusts a distance between the nozzle and a portion of the workpiece facing the nozzle so that the gas flow blown from the nozzle impinges on workpieces of various dimensions at a constant flow velocity, a controller to which a dimension of the workplace is input, the controller connected to the driving mechanism, and outputting the dimension of the workpiece to control the driving mechanism, and a sensor that automatically detects the dimension of the workpiece in advance, and inputs the dimension to the controller, wherein a plurality of nozzles are arranged as the nozzle along a conveying direction of the workpiece in a zone where the thermal processing is performed, and the driving mechanism adjusts a distance between each of the nozzles and a portion of the workpiece facing the nozzle individually in each of the plurality of nozzles.

4. The furnace according to claim 3, wherein the driving mechanism drives the blowing hood or the nozzle to adjust the distance between the nozzle and the portion of the workpiece.

5. A thermal processing furnace for workpieces having a blowing hood in which a nozzle is installed, the nozzle blowing a gas flow to thermally process a workpiece, comprising:

a driving mechanism that adjusts a distance between the nozzle and a portion of the workpiece facing the nozzle so that the gas flow blown from the nozzle impinges on workpieces of various dimensions at a desired flow velocity, a controller to which a dimension of the workpiece is input, the controller connected to the driving mechanism, and outputting the dimension of the workpiece to control the driving mechanism, and a sensor that automatically detects the dimension of the workpiece in advance, and inputs the dimension to the controller, wherein the workpiece is conveyed by a conveyor while moving up and down, and the driving mechanism adjusts the distance between the nozzle and the portion of the workpiece so that an up-and-down speed and an up-and-down stroke of the adjustment are equivalent to an up-and-down speed and an up-and-down stroke of the workpiece, respectively.

6. The furnace according to claim 5, wherein the driving mechanism drives the blowing hood or the nozzle to adjust the distance between the nozzle and the portion of the workpiece.

7. A thermal processing furnace for workpieces having a blowing hood in which a nozzle is installed, the nozzle blowing a gas flow to thermally process a workpiece, comprising:

a driving mechanism that adjusts a distance between the nozzle and a portion of the workpiece facing the nozzle so that the gas flow blown from the nozzle impinges on workpieces of various dimensions at a constant flow velocity, a controller to which a dimension of the workplace is input, the controller connected to the driving mechanism, and outputting the dimension of the workpiece to control the driving mechanism, and a sensor that automatically detects the dimension of the workpiece in advance, and inputs the dimension to the controller, wherein the workpiece is conveyed by a conveyor while moving up and down, and the driving mechanism adjusts the distance between the nozzle and the portion of the workpiece so that an up-and-down speed and an up-and-down stroke of the adjustment are equivalent to an up-and-down speed and an up-and-down stroke of the workpiece, respectively.

8. The furnace according to claim 7, wherein the driving mechanism drives the blowing hood or the nozzle to adjust the distance between the nozzle and the portion of the workpiece.

* * * * *